US007240902B2

(12) United States Patent
Hughes

(10) Patent No.: US 7,240,902 B2
(45) Date of Patent: Jul. 10, 2007

(54) NO GLUE PUZZLE FRAME

(75) Inventor: La Verne Hughes, 1501 Vandiver Dr., #132, Columbia, MO (US) 65202

(73) Assignee: La Verne Hughes, Columbia, MO (US)

( * ) Notice: Subject to any disclaimer, the term of this patent is extended or adjusted under 35 U.S.C. 154(b) by 0 days.

(21) Appl. No.: 10/851,744

(22) Filed: May 24, 2004

(65) Prior Publication Data

US 2005/0282139 A1 Dec. 22, 2005

(51) Int. Cl.
*A63F 9/12* (2006.01)

(52) U.S. Cl. ..... 273/157 R

(58) Field of Classification Search ..... 273/157 R; 434/365; 40/700, 745, 765, 768, 790
See application file for complete search history.

(56) References Cited

U.S. PATENT DOCUMENTS 2,003,072 A * 5/1935 Eynon ..... 273/157 R
2,506,189 A * 5/1950 Attridge ..... 273/157 R
4,111,425 A * 9/1978 Lathrop ..... 273/157 R
4,154,339 A * 5/1979 Dutra ..... 206/315.1
D265,276 S * 7/1982 Malin ..... D6/303
4,552,361 A * 11/1985 LaFleur ..... 273/157 R
4,687,202 A * 8/1987 Palma ..... 273/157 R
5,405,146 A * 4/1995 Washington ..... 273/157 R
5,624,118 A * 4/1997 Gottesman ..... 273/157 R
5,651,547 A * 7/1997 Rannelli ..... 273/157 R
6,564,957 B2 * 5/2003 Caldwell ..... 273/157 R

* cited by examiner

*Primary Examiner*—Kurt Fernstrom

(57) ABSTRACT

"Frame Your Puzzle" is the alternative framing method for puzzles, in comparison to what is currently available. Gluing is currently required to frame a jigsaw puzzle in a picture frame. "Frame Your Puzzle" eliminates the need for gluing. This allows the puzzle to be displayed, and later, to be disassembled and placed back in its box for future assembling.

1 Claim, 12 Drawing Sheets

NO GLUE PUZZLE FRAME

BACKGROUND OF THE INVENTION

Brief Summary of the Invention

"Frame Your Puzzle" is the answer to the jigsaw puzzlers' dilema for displaying their puzzles. "Frame Your Puzzle" is the first framing system that does not require that the back of the finished puzzle be glued. Now a jigsaw puzzle does not have to be destroyed with glue, but can remain reworkable for the duration of its life.

DETAILED DESCRIPTION OF THE INVENTION

"Frame Your Puzzle" is an ingenious method for displaying puzzles without destroying them. It consists of:

1. picture frame moulding
2. spring clips
3. sawtooth hangers
4. acrylic plexiglass
5. foam board
6. matboard These frames come in three different sizes: 18"×24", 23"×30", and 30"×42".

Currently, puzzles to be framed, are taken to a frame shop where they are permanently afffixed with glue to a matboard, or some other backing board, with a matboard border. The drawbacks to this method are the following:

1. The puzzle is permanently assembled.

2. A new frame must be purchased for the next puzzle, unless the old puzzle is to be discarded.

3. A costly method, because of the need to always purchase a new frame for each puzzle to be displayed.

4. Will need to either discard the old puzzles, or find extra room for the additional framed puzzles.

Referring now, particularly to FIG. 1, which is an aerial view, showing the front of the assembled puzzle frame. The picture frame moulding 4 will be sized larger than the puzzle, which will allow the matboard 5 to border the puzzle 6. The total look is the same as a framed picture. The picture frame moulding 4 can be rectangular or round. Acrylic plexiglass 7 is used, instead of glass, because of its flexibility. This allows the acrylic plexiglass 7 to mold itself around the puzzle 6, which prevents the puzzle 6 from slipping out of its position.

FIG. 2 is an aerial view showing the back of the assembled puzzle frame. Spring clips 1 and 2 are used because they am strong, which helps to apply a firm pressure against the foam board 8 backing. Thus, the puzzle stays in its position without the use of glue The swivel action of the spring clips 1 and 2 simplifies assembling. At this point, the framed puzzle is ready to be hung on the wall using the attached sawtooth hangers 1 and 3. One sawtooth hanger 1 and 3 is at the top of the picture frame moulding 4 and one is on the side of the picture frame moulding 4. (More spring clips 1 and 2, and sawtooth hangers 1 and 3 are on the larger puzzle frames.)

FIG. 3 shows the side view of the disassembled puzzle frame, to show how the different components will be arranged to assemble the puzzle frame. The foam board 8 provides the base for assembling Next comes the matboard 5 which is placed on top of the foam board 8. The finished puzzle 6 is then centered on top of the matboard 5. The acrylic plexiglass 7 is carefully placed on top of the puzzle 6 and matboard 5. Next, the picture frame moulding 4 is placed over the acrylic plexiglass 7. The assembled puzzle frame is then moved to the edge of the table, with each side moved out beyond the table and rotated to each of the puzzle frame sides, in order for the spring clips 1 and 2 to be swiveled into a position to press against the foam board 8. (The picture frame moulding 4 will already have the spring clips 1 and 2, as well as the sawtooth hangers 1 and 3 attached to the back of it.) After assembling, the puzzle frame is ready for hanging.

FIG. 4 is the sideview of the type of spring clip 1 and 2 used. The spring clip 2, itself, needs to have the dimensions of ⅜"×3⅛". The screw 1, itself, should be ½" long.

FIG. 5 shows the aerial view of the spring clip 1 and 2.

FIG. 6 shows the front view of the sawtooth hanger 1 and 3. The dimension of the sawtooth hanger 3, itself, should be 3" long. The screw 1, itself, should be ½" long.

CROSS-REFERENCE TO RELATED APPLICATIONS

"Not Applicable"

STATEMENT REGARDING FEDERALLY SPONSORED RESEARCH OR DEVELOPMENT

"Not Applicable"

SEQUENCE LISTING (when necessary)

"Not Applicable"

BRIEF DESCRIPTION OF THE SEVERAL VIEWS OF THE DRAWING (None of the drawings are based on the actual measurements.)

View 1

FIGS. 1, 2, 3, 4, and 5 are all based on the plexiglass size. The assortment of sizes are: 18"×24", 23"×30", and 30"×42"

Figure 1:
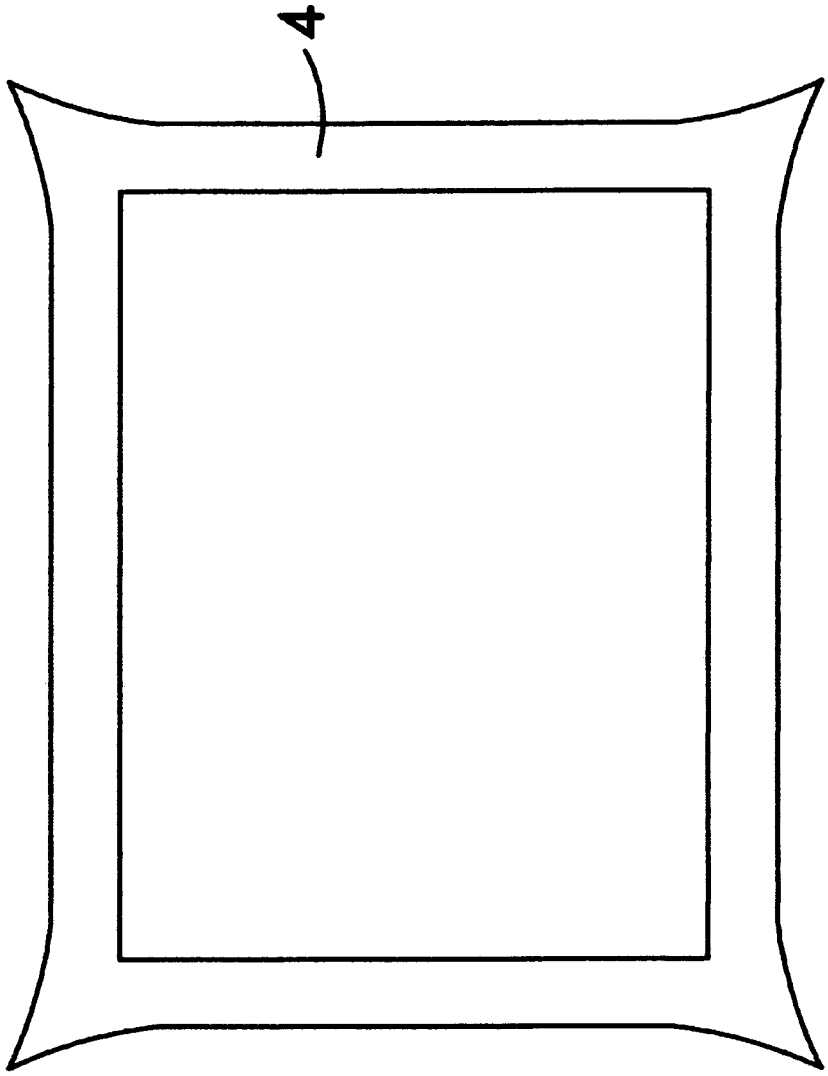
FIG. 1 is an aerial view of the front side of the assembled puzzle frame, with the puzzle in it.
Figure 2:
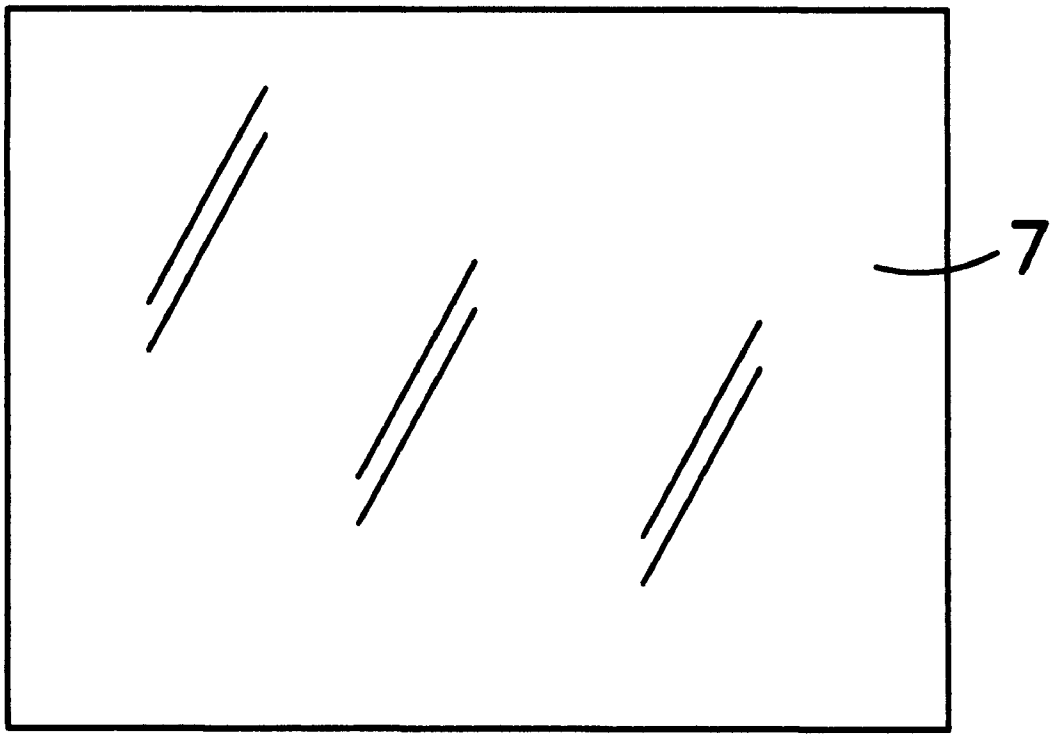
FIG. 2 is an aerial view of the back side of the assembled puzzle frame, showing the foam board back, saw tooth hangers, and the spring clips, in place.
Figure 3:
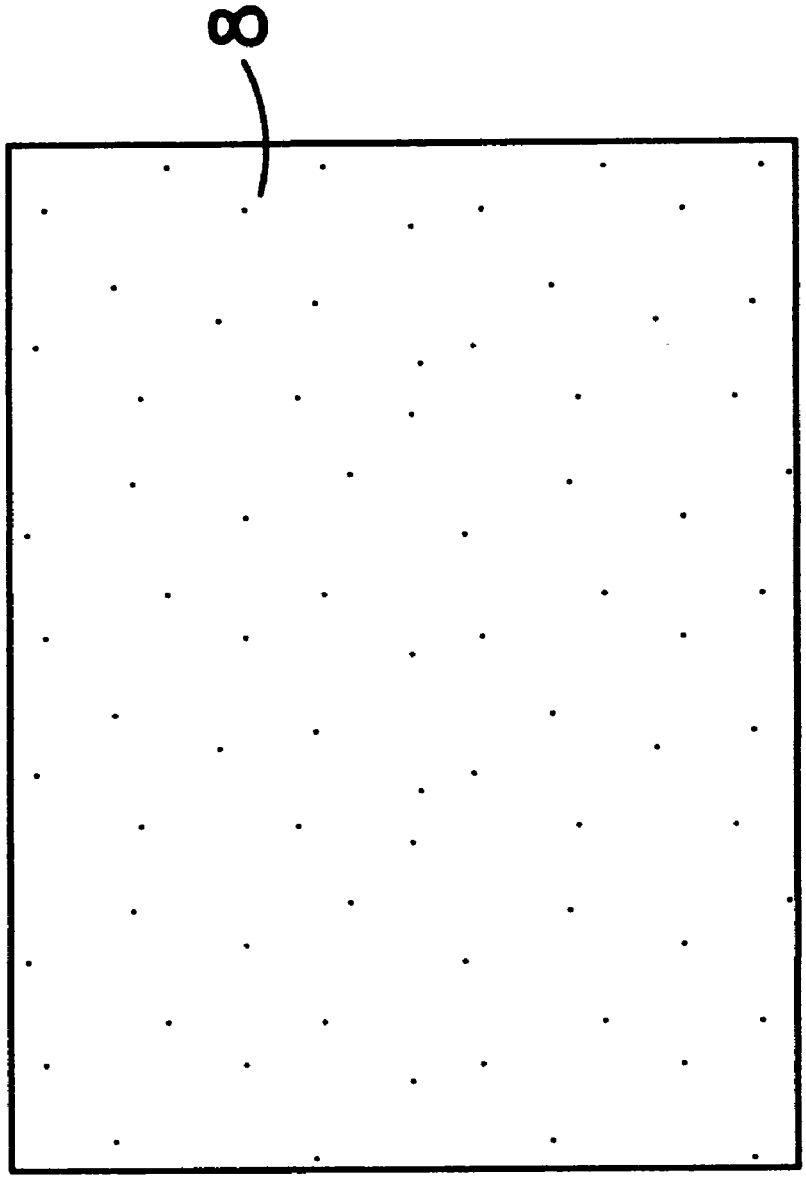
FIG. 3 is a side view of the disassembled puzzle frame, to show the order for assembling the puzzle frame, complete with, the puzzle in it.
Figure 4:
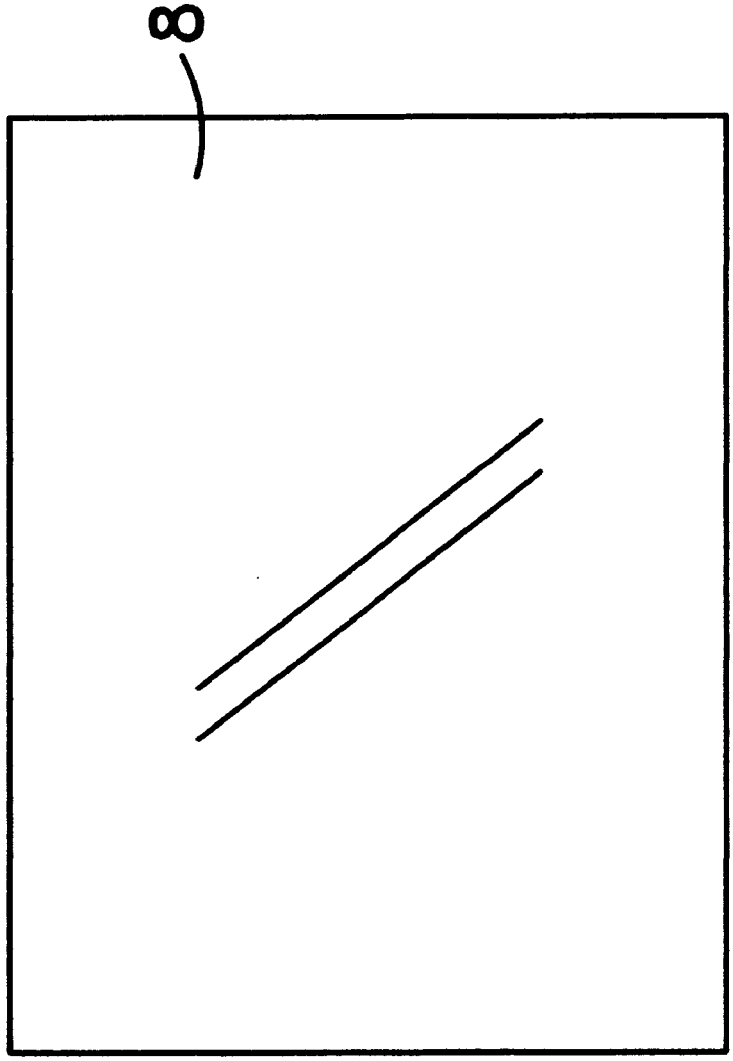
FIG. 4 is a side view of the spring clip and screw.
Figure 5:
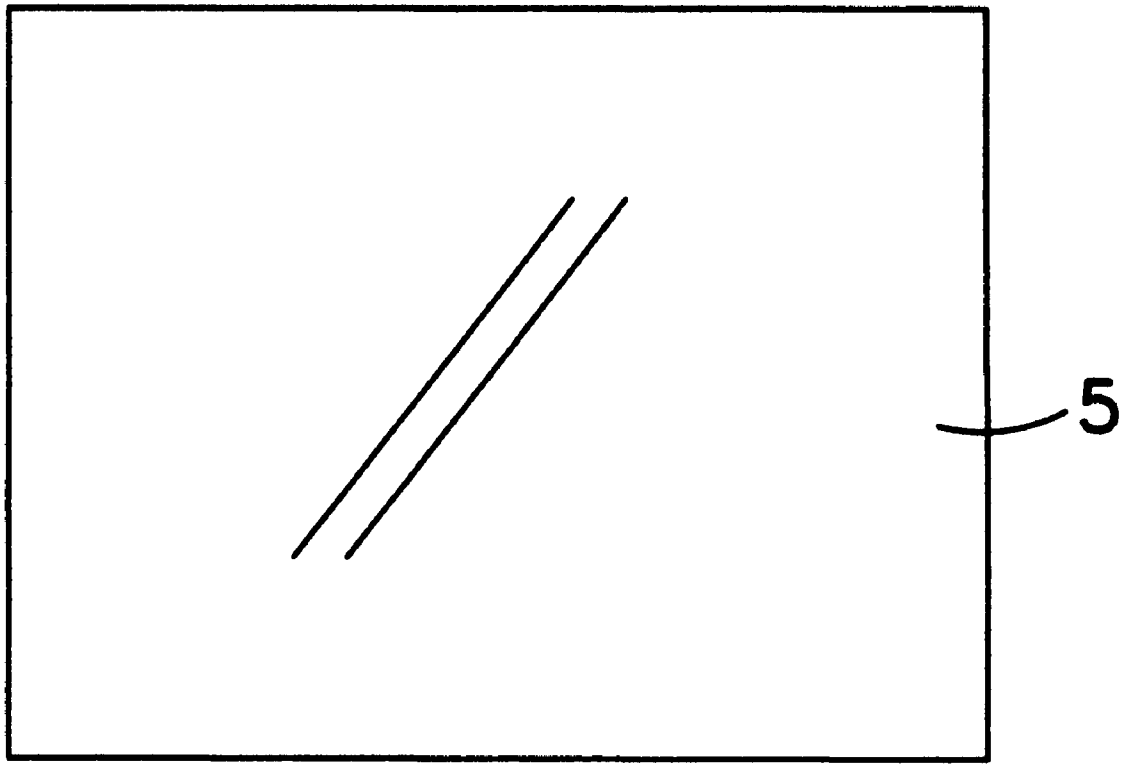
FIG. 5 is an aerial view of the spring clip and screw.
Figure 6:
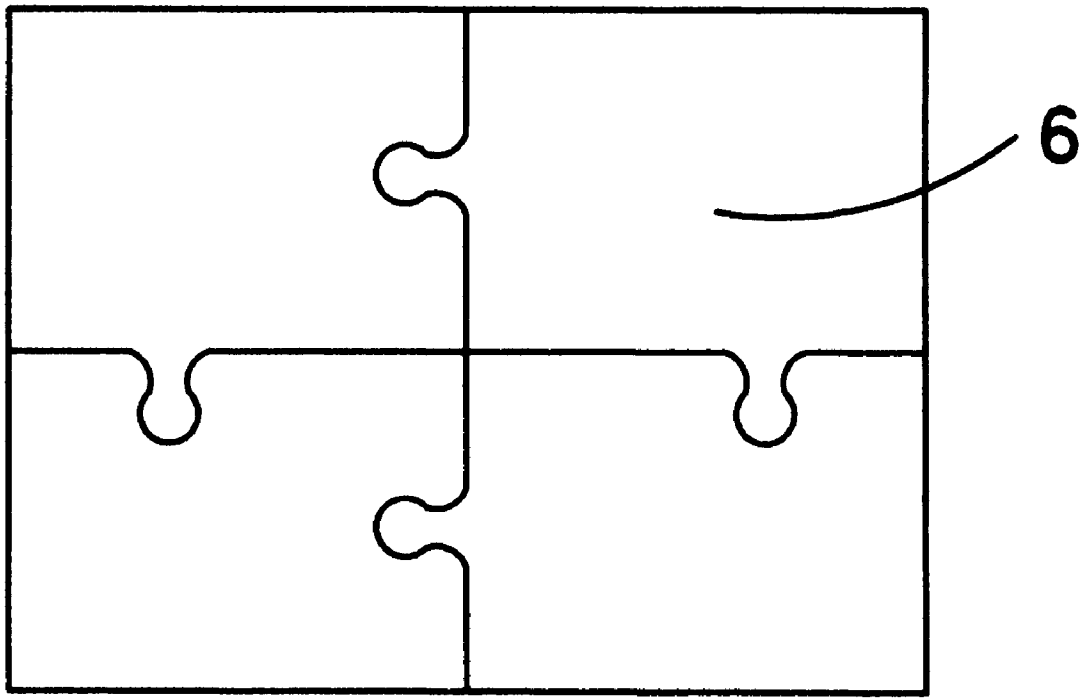
FIG. 6 is the front view of the sawtooth hanger and screws.

FIG. 6 measurements are as follows:

| puzzle size up to - | for plexiglass size - |
|---|---|
| 16" × 22" | 18" × 24" |
| 21" × 28" | 23" × 30" |
| 28" × 41" | 30" × 42" |

View 2

Figure 7:
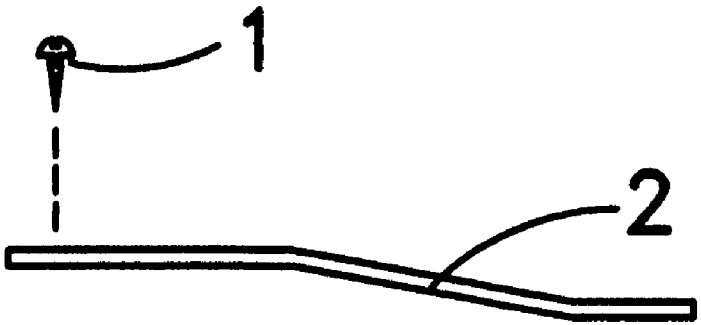

Under FIG. 7:

⅜" wide, 3⅛" long (canceled)

1—screw (measurement is ½")

2—spring clip with a hole for the screw, at the top (measurement is ⅜"×3⅛")

Figure 8:
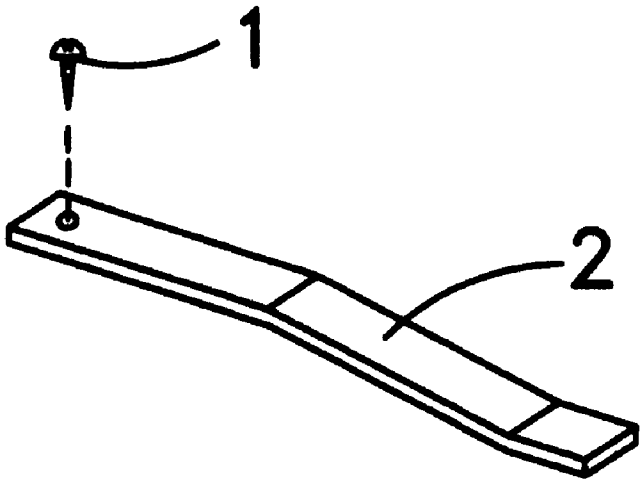

FIG. 8—spring clip-aerial view with a screw above the hole in which it goes into, as indicated by the broken lines.

1—(same as in FIG. 7)

2—(same as in FIG. 7)

Figure 9:
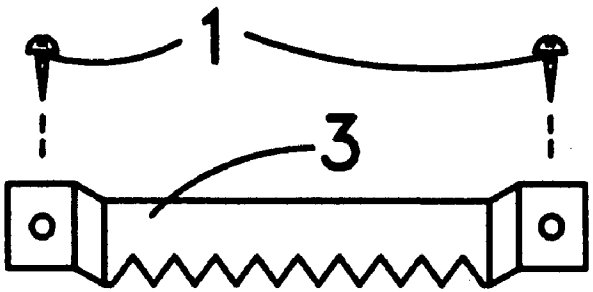

FIG. 9—sawtooth hanger-with screws above the holes in which they go into, as indicated by the broken lines.

(measurement is 3" long)

1—(same as in FIG. 7)

3—sawtooth hanger with a hole on each side for a screw (measurement is 3" long)

Figure 10:
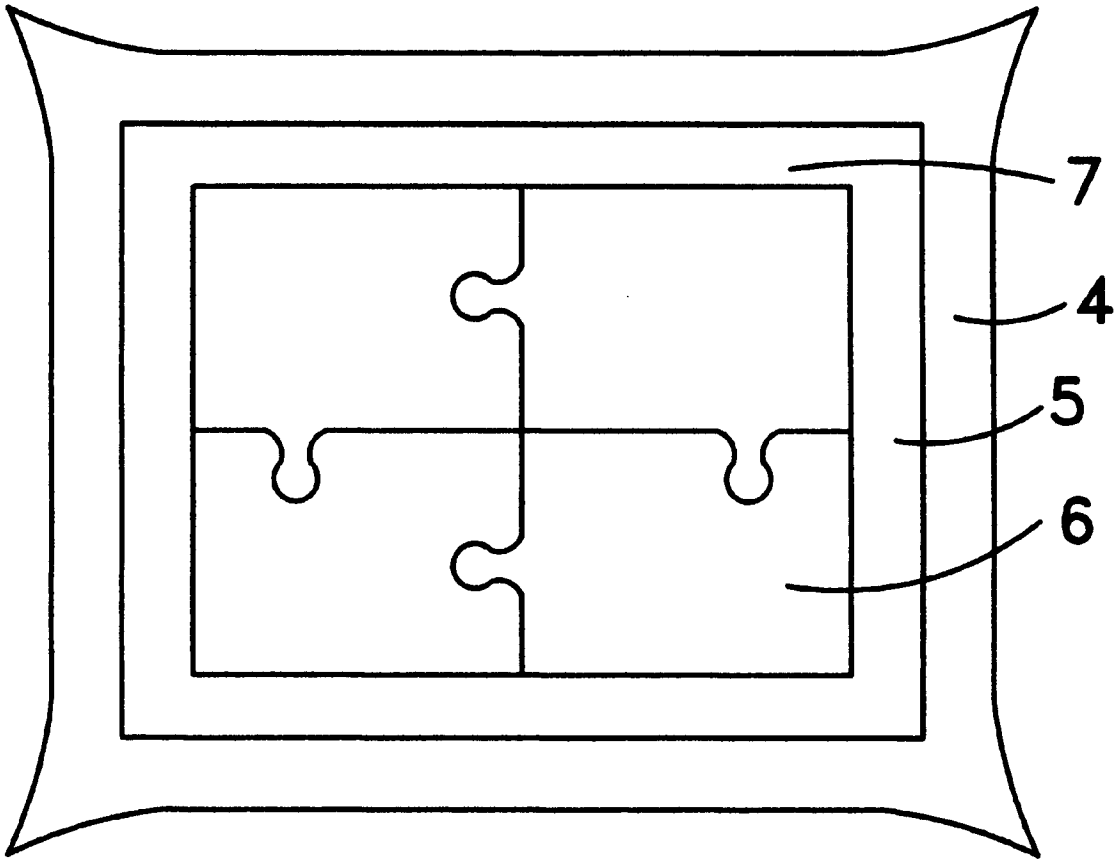

View 3:

FIG. 10—aerial view of the front side of the assembled puzzle frame, with the puzzle in it.

Under FIG. 10:

4—picture frame moulding

5—matboard, which is under the puzzle, and is showing through the acrylic plexiglass

6—assembled puzzle, showing through the acrylic plexiglass

7—acrylic plexiglass covering

Figure 11:
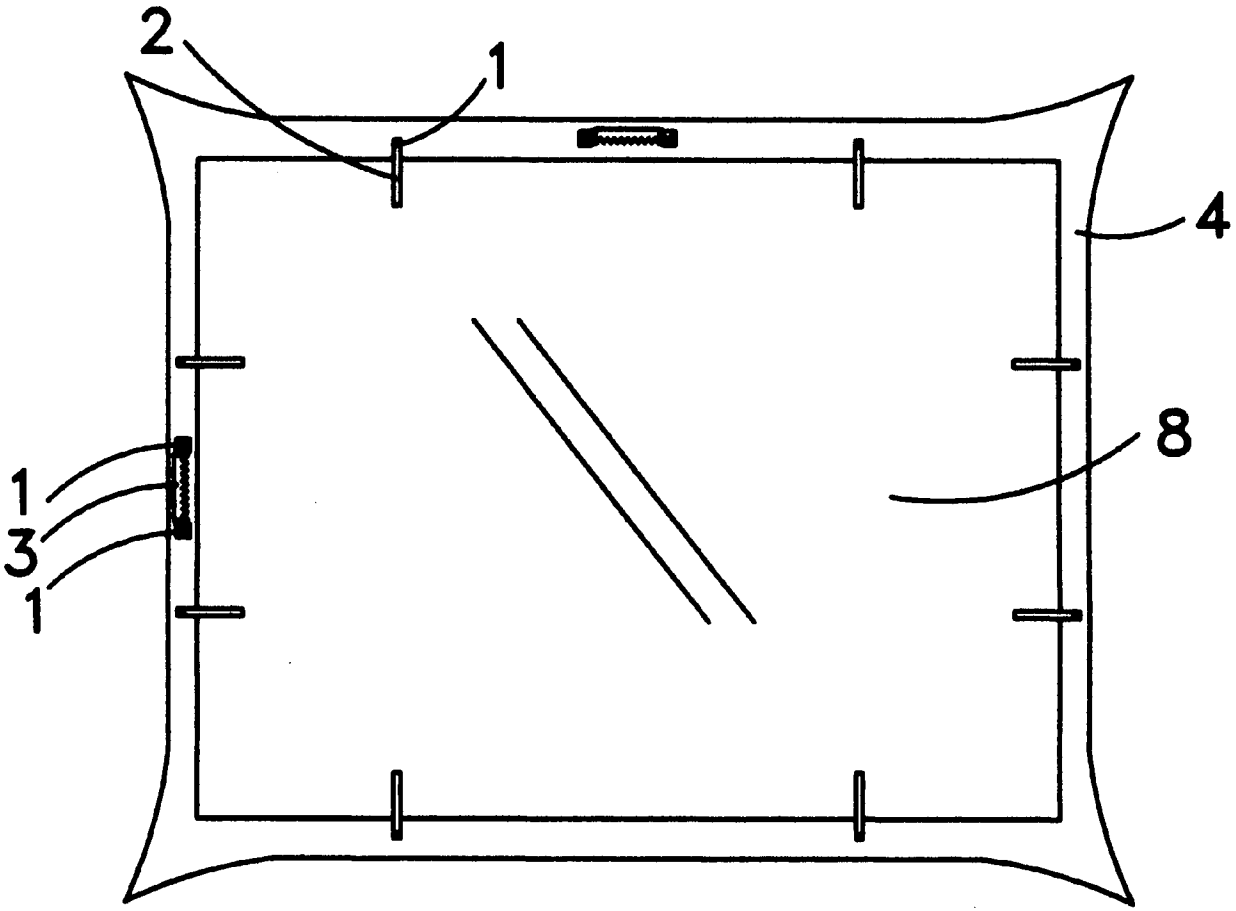

FIG. 11 aerial view of the back side of the assembled puzzle frame showing the foam board back, sawtooth hangers, and the spring clips in place.

4—picture frame moulding

8—foam board back

1 and 2—spring clip attached, with screw, to the back of the picture frame moulding

Figure 12:
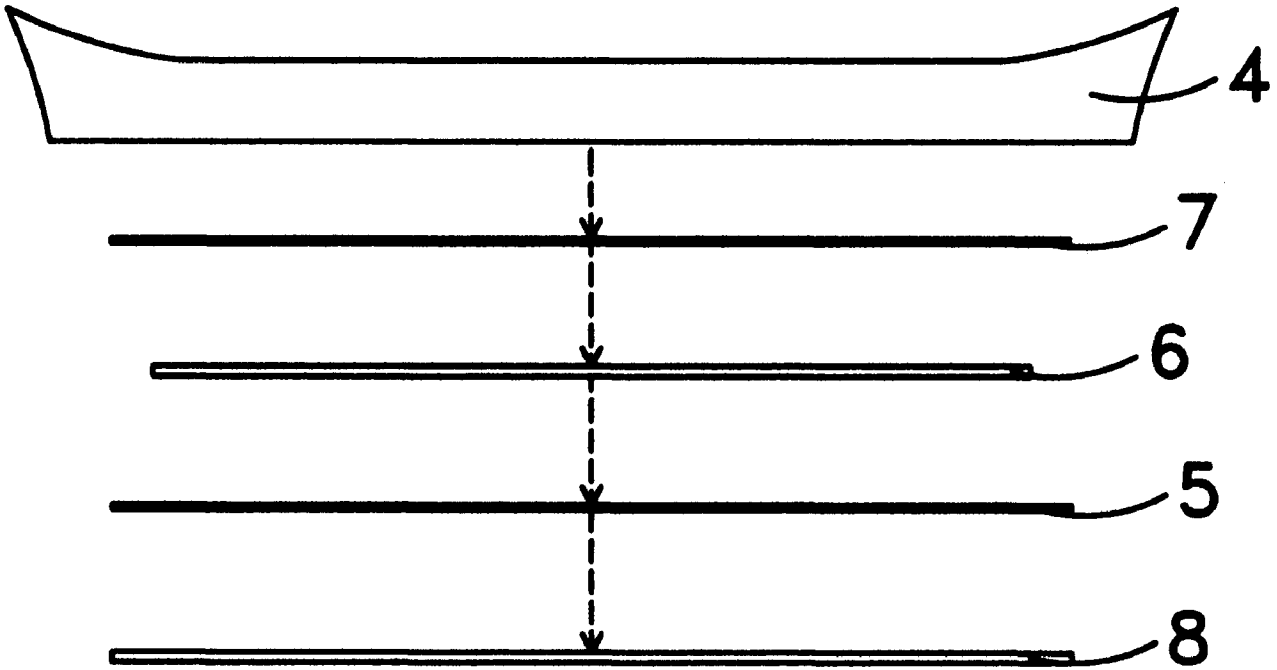

1 and 3—sawtooth hanger attached, with screws, to the back of the picture frame moulding View 4:

FIG. 12—shows the order of assembling the puzzle frame, complete with the puzzle.

4—picture frame moulding placed over ref. 7

7—the acrylic plexiglass, which is over ref. 6

6—the puzzle, which is on top of ref. 5

5—the matboard, which is on top of ref. 8

8—the foam board

The broken lines, with arrows, indicate which items are placed on top of the others. The order, in which these items are placed for assembling, will be the reverse.

What I claim as my invention is:

1. A device for framing jigsaw puzzles without the use of glue, comprising of:

a picture frame moulding;

a sheet of acrylic plexiglass;

a sheet of matboard and a sheet of foam board, both having substantially the same dimensions as the sheet of acrylic plexiglass;

a plurality of sawtooth hangers attached to the back of the picture frame moulding, and adapted to hang the device on a wall; and a plurality of spring clips which are adapted to provide pressure to the back of the foam board and matboard, such that a jigsaw puzzle can be placed and secured between the acrylic plexiglass and the matboard without the use of glue, and without slipping when the device is hung on a wall.

* * * * *